US009321560B2

(12) United States Patent
Dowler et al.

(10) Patent No.: US 9,321,560 B2
(45) Date of Patent: Apr. 26, 2016

(54) CHILD RESISTANT CLOSURE SYSTEM INCLUDING HOOD ARRANGEMENT FOR RECLOSEABLE BAG AND METHODS

(71) Applicant: Reynolds Presto Products Inc., Lake Forest, IL (US)

(72) Inventors: Roger E. Dowler, Rochester, NY (US); William D. Coffey, Rochester, NY (US); Janet M. Fleury, Canandaigua, NY (US)

(73) Assignee: Reynolds Presto Products Inc., Lake Forest, IL (US)

( * ) Notice: Subject to any disclaimer, the term of this patent is extended or adjusted under 35 U.S.C. 154(b) by 0 days.

(21) Appl. No.: 14/208,223

(22) Filed: Mar. 13, 2014

(65) Prior Publication Data

US 2014/0270596 A1 Sep. 18, 2014

Related U.S. Application Data

(60) Provisional application No. 61/792,058, filed on Mar. 15, 2013.

(51) Int. Cl.

| | |
|---|---|
| ***B65D 33/16*** | (2006.01) |
| ***B65D 33/24*** | (2006.01) |
| ***B65D 33/25*** | (2006.01) |

(52) U.S. Cl.

CPC ..... *B65D 33/24* (2013.01); *B65D 33/2591* (2013.01)

(58) Field of Classification Search

CPC ..... B65D 33/2591; B65D 33/2508; Y10T 24/2534

USPC ..... 383/64, 61.2, 203, 204

See application file for complete search history.

(56) References Cited

U.S. PATENT DOCUMENTS

| | | | | |
|---|---|---|---|---|
| 1,759,283 | A * | 5/1930 | Schmidt | 70/68 |
| 1,759,284 | A * | 5/1930 | Schmidt | 70/68 |
| 1,771,429 | A * | 7/1930 | Wisbith | 383/97 |
| 1,959,318 | A * | 5/1934 | Sundback | 24/400 |
| 4,661,990 | A * | 4/1987 | Rifkin | 383/97 |
| 5,007,143 | A | 4/1991 | Herrington | |
| 5,681,115 | A | 10/1997 | Diederich et al. | |
| 5,711,609 | A | 1/1998 | Simonsen | |
| 5,713,669 | A | 2/1998 | Thomas et al. | |

(Continued)

FOREIGN PATENT DOCUMENTS

| | | | |
|---|---|---|---|
| EP | 1 366 999 | A1 | 12/2003 |
| EP | 2 284 091 | A1 * | 2/2011 |

(Continued)

OTHER PUBLICATIONS

Machine translation of European Patent Office Document No. 2 284 091. Translated on Feb. 9, 2015.*

(Continued)

*Primary Examiner* — Jes F Pascua

(74) *Attorney, Agent, or Firm* — Merchant & Gould P.C.

(57) ABSTRACT

A child resistant zipper closure for a plastic bag includes a zipper closure having a hood arrangement that includes at least a non-removable hood section in covering relation to a first portion of the zipper closure. There can be slider to open and close the closure, and the non-removable hood section will be sized to accommodate the slider. The hood arrangement can include a removable section to expose the zipper closure and allow access to the slider.

16 Claims, 9 Drawing Sheets

(56) References Cited

U.S. PATENT DOCUMENTS

| | | | | |
|---|---|---|---|---|
| 5,775,812 | A | 7/1998 | St. Phillips et al. | |
| 6,036,364 | A | 3/2000 | Heuvel | |
| 6,053,635 | A * | 4/2000 | Anderson et al. | 383/10 |
| 6,273,607 | B1 * | 8/2001 | Buchman | 383/5 |
| 6,286,999 | B1 | 9/2001 | Cappel et al. | |
| 6,287,000 | B1 | 9/2001 | Buchman | |
| 6,361,213 | B2 | 3/2002 | Randall | |
| 6,376,035 | B1 | 4/2002 | Dobreski et al. | |
| 6,385,818 | B1 * | 5/2002 | Savicki, Sr. | 24/30.5 R |
| 6,409,384 | B1 | 6/2002 | Provan et al. | |
| 6,786,640 | B2 * | 9/2004 | Schneider et al. | 383/5 |
| 6,846,108 | B2 | 1/2005 | Buchman | |
| 6,974,256 | B2 * | 12/2005 | Kinigakis | B65D 33/2591 383/204 |
| 7,246,944 | B2 * | 7/2007 | Bois | 383/5 |
| 7,255,477 | B2 | 8/2007 | Arnell | |
| 7,416,340 | B2 | 8/2008 | Schneider | |
| 7,524,110 | B2 | 4/2009 | Anzini et al. | |
| 7,543,362 | B2 | 6/2009 | Olechowski | |
| 7,946,003 | B2 | 5/2011 | Sprague et al. | |
| 8,893,356 | B2 * | 11/2014 | Ozaki et al. | 24/430 |
| 9,009,930 | B2 * | 4/2015 | Plourde | 24/436 |
| 2003/0002753 | A1 * | 1/2003 | Stolmeier et al. | 383/64 |
| 2003/0014848 | A1 | 1/2003 | LaRue et al. | |
| 2003/0138171 | A1 | 7/2003 | Kikuchi | |
| 2004/0083782 | A1 | 5/2004 | Lantz | |
| 2005/0157959 | A1 | 7/2005 | Johnson | |
| 2005/0257351 | A1 | 11/2005 | Pitts et al. | |
| 2006/0008186 | A1 | 1/2006 | Kusz | |
| 2006/0072854 | A1 * | 4/2006 | Schreiter | 383/5 |
| 2006/0133700 | A1 | 6/2006 | Cappel | |
| 2006/0168779 | A1 | 8/2006 | Chaturvedi | |
| 2007/0071367 | A1 | 3/2007 | Buchman | |
| 2008/0063321 | A1 * | 3/2008 | Hodson et al. | 383/64 |
| 2009/0139067 | A1 | 6/2009 | Ackerman | |
| 2012/0141049 | A1 * | 6/2012 | Paulin | 383/64 |

FOREIGN PATENT DOCUMENTS

| | | | |
|---|---|---|---|
| WO | WO 03/018417 | A1 | 3/2003 |
| WO | WO 2009/112078 | A1 | 9/2009 |
| WO | WO 2010/008917 | A1 | 1/2010 |
| WO | WO 2010/029455 | A1 | 3/2010 |

OTHER PUBLICATIONS

International Search Report and Written Opinion for PCT/US2014/022679 mailed Jul. 22, 2014.

* cited by examiner

CHILD RESISTANT CLOSURE SYSTEM INCLUDING HOOD ARRANGEMENT FOR RECLOSEABLE BAG AND METHODS

CROSS REFERENCE TO RELATED APPLICATIONS

This application claims the benefit of provisional application Ser. No. 61/792,058, filed Mar. 15, 2013, which is incorporated herein by reference in its entirety.

TECHNICAL FIELD

This disclosure relates to reclosable zipper pouch. More particularly, this disclosure relates to a reclosable zipper pouch that is child resistant.

BACKGROUND

A reclosable pouch having a zipper closure can be easy to open for children and adults. If the pouch is intended to have contents that are potentially harmful, there is a need to provide a closure and method to increase the difficulty for children to open the pouch and yet still be easy to open for adults and senior citizens.

SUMMARY

In one aspect, a child resistant slider zipper closure system is provided having a non-removable hood to cover the slider.

The slider zipper closure system can include the non-removable hood being positioned to cover the slider in the closed position.

The slider can be moved from under the non-removable hood to slide along the zipper.

The method to move the slider from under the non-removable hood will not be intuitive to small children.

The method to move the slider from under the non-removable hood can require physical dexterity not typical of small children.

The non-removable hood can be accompanied by a removable hood portion.

The non-removable hood can be non transparent.

In another aspect, a flexible package with a child resistant slider zipper closure system is provided having of a non-removable hood to cover the slider.

The flexible package may include the non-removable hood being positioned to cover the slider in the closed position.

The flexible package may include the slider being moved from under the non-removable hood to slide along the zipper.

The flexible package may include a method to move the slider from under the non-removable hood is not intuitive to children.

The flexible package may include the method to move the slider from under the non-removable hood requires physical dexterity not typical of small children.

The flexible package may include the non-removable hood being accompanied by a removable hood portion.

The flexible package may include the non-removable hood being non transparent.

In one aspect, a zippered plastic bag having an openable and recloseable mouth is provided. The bag includes first and second panels each having a top forming the mouth, a bottom, and first and second opposing sides. The first and second panels are joined to each other along their respective bottoms, their respective first opposing sides, and their respective second opposing sides. A zipper closure is provided. The zipper closure includes a male and female track. The male track includes a male profile in proximity to the top of the first panel. The female track includes a female profile in proximity to the top of the second panel. The male and female profiles have complementary cross sections for interlocking to close the mouth and for unlocking to open the mouth. A hood arrangement includes at least a non-removable hood section in covering relation to a first portion of the zipper closure.

In example aspects, the hood arrangement includes an open position and a closed position. In the closed position, the hood arrangement covers an entire extension of the zipper closure. In the open position, the hood arrangement includes only the non-removable hood section and covers no more than the first portion of the zipper closure.

In example aspects, the hood arrangement is secured to the first and second panels. In the closed position, the hood arrangement includes a removable hood section and the non-removable hood section. The removable hood section is removable from the first and second panels to expose the zipper closure when removed.

In example arrangements, the first and second panels are scored to permit removal of the removable hood section.

In example aspects, the non-removable hood section is non-transparent.

In example aspects, a slider is provided to move along the male and female tracks to open and close the profile members. The non-removable hood section will be sized to accommodate the slider.

In another aspect, a method of operating a zippered plastic bag having an openable and recloseable mouth is provided. The method includes providing a zippered plastic bag having first and second panels each having a top forming the mouth, a bottom, and first and second opposing sides. The first and second panels are joined to each other along their respective bottoms, their respective first opposing sides, and their respective second opposing sides. A zipper enclosure includes a male and female track. The male track includes a male profile in proximity to the top of the first panel. The female track includes a female profile in proximity to the top of the second panel. The male and female profiles have complementary cross sections for interlocking to close the mouth and for unlocking to open the mouth. A hood arrangement includes at least a non-removable hood section in covering relation to a first portion of the zipper closure. The method includes opening the mouth by accessing the zipper closure within the non-removable hood section and then unlocking the male and female profiles.

In example aspects, the hood arrangement includes a removable hood section and the non-removable hood section. The method includes, before the step of opening the mouth, removing the removable hood section to expose a portion of the zipper closure.

In example aspects, the step of removing the removable hood section includes tearing the removable hood section from the first and second panels along a score line.

In example aspects, there is slider is located on the zipper closure, and the method includes opening the mouth by locating the slider within the non-removable hood section, and moving the slider along the male and female tracks to open the mouth by unlocking the male and female profiles.

In example aspects, the step of moving the slider includes either pinching the slider through the non-removable hood section, or hooking the slider with a finger, or temporarily peeling back the non-removable hood section.

A variety of examples of desirable product features or methods are set forth in part in the description that follows, and in part will be apparent from the description, or may be learned by practicing various aspects of this disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Figure 1:
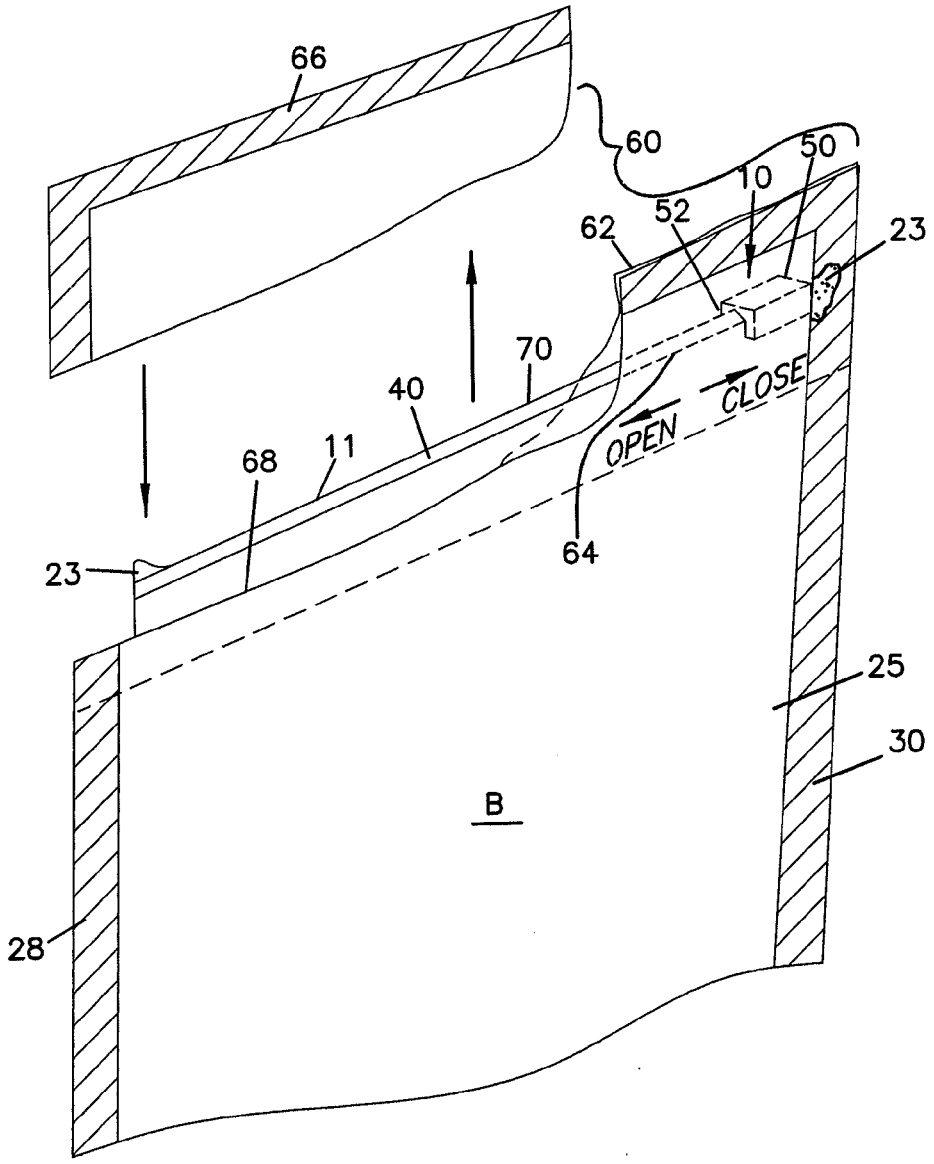
FIG. 1 is a schematic front view of one embodiment of a recloseable bag having a zipper closure and a slider, a removable hood section of the bag shown removed from a remaining portion of the bag, constructed in accordance with principles of this disclosure.
Figure 4:
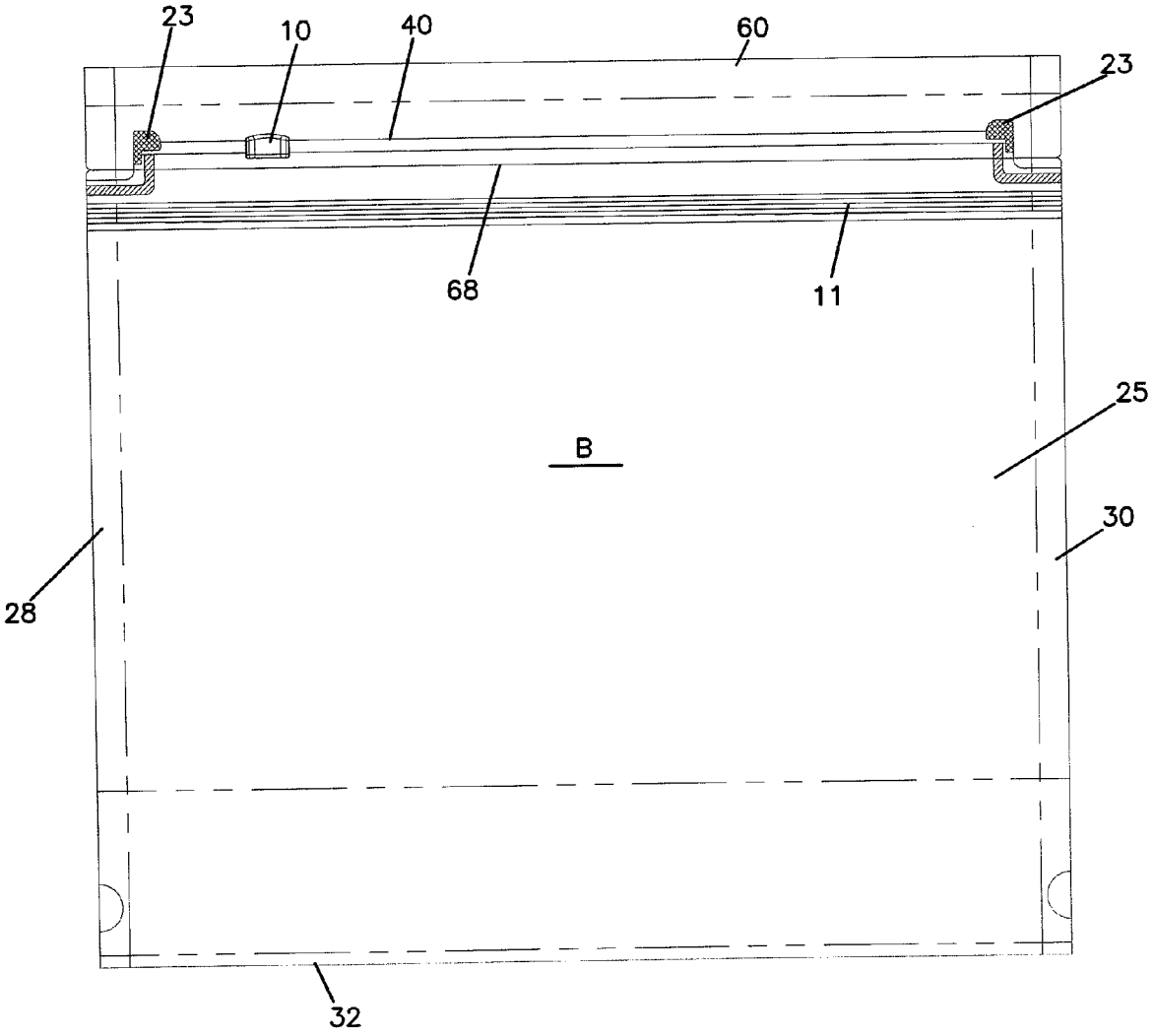
FIG. 4 is a front view of the recloseable bag of FIG. 1 and showing the bag before a removable hood section is removed.
Figure 5:
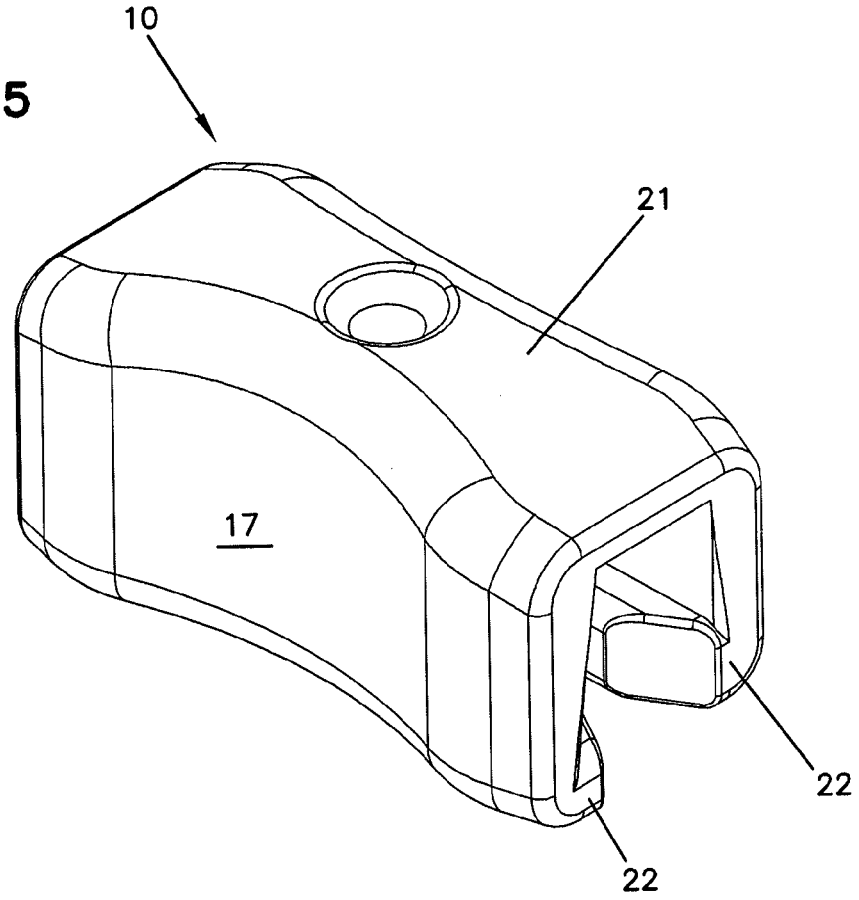
FIG. 5 is a perspective view of one example slider useable in the bag of FIGS. 1 and 4.
Figure 6:
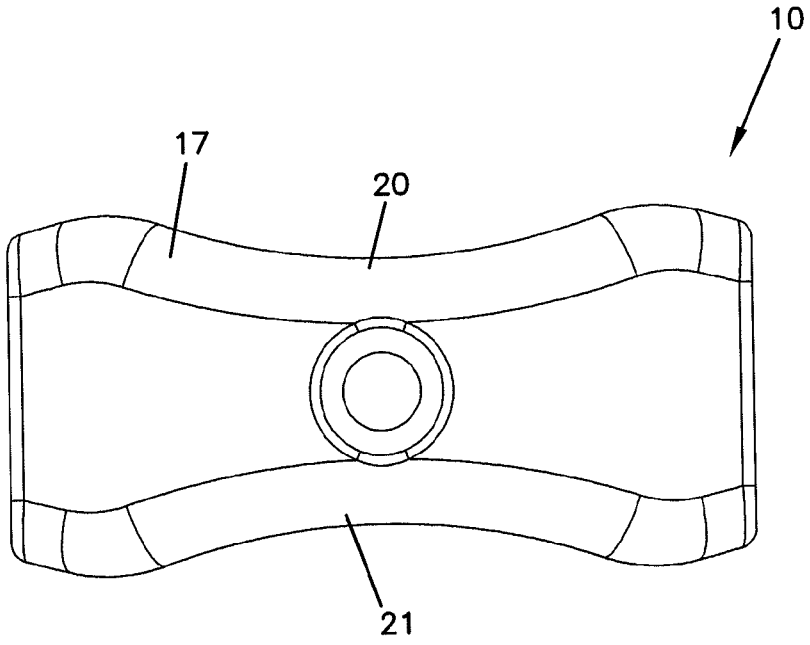
FIG. 6 is a top view of the slider of FIG. 5.
Figure 7:
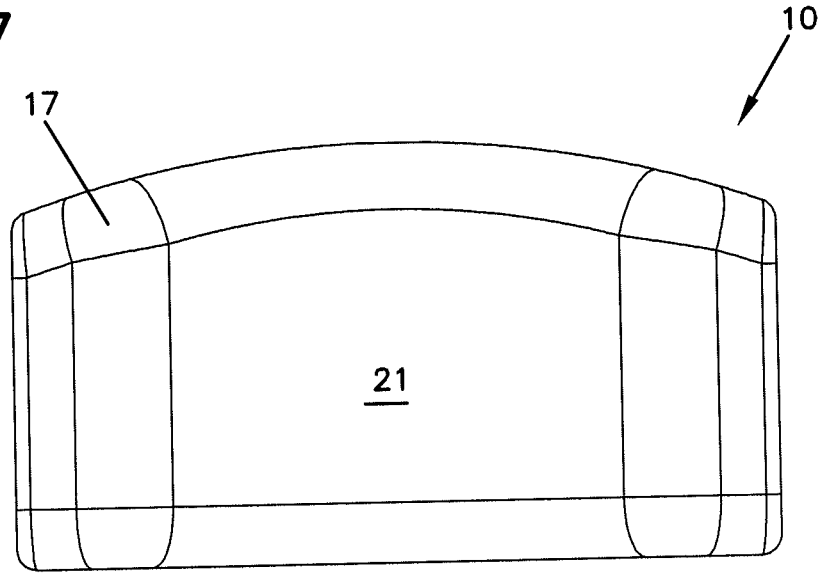
FIG. 7 is a side view of the slider of FIG. 5.
Figure 8:
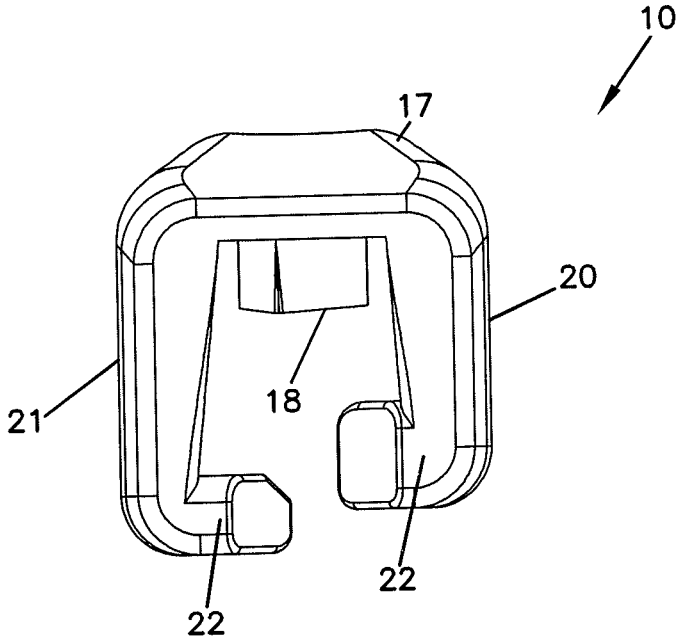
FIG. 8 is an end view of the slider of FIG. 5.

Referring to FIGS. 1 and 4, there is illustrated a pouch, package B, or thermoplastic bag B having a profiled plastic fastener or zipper closure 11. The zipper closure 11 may optionally be openable and recloseable with a slider 10.

The slider 10 has been illustrated in FIG. 1 assembled on the zipper closure 11 at the top edge or mouth 40 of the bag B. In the example embodiment, the bag B is formed from a single flexible plastic sheet folded upon itself and comprises first and second opposing body panels 25 and 26. Body panels 25 and 26 are fixedly connected to each other along a pair of sides 28 and 30 and a bottom 32 which extends between the pair of sides 28 and 30. Bag B preferably has the zipper closure 11 extending along mouth 40 formed opposite the bottom 32 of bag B, in which the zipper closure 11 has a male track 12 and a female track 13.

Figure 3:
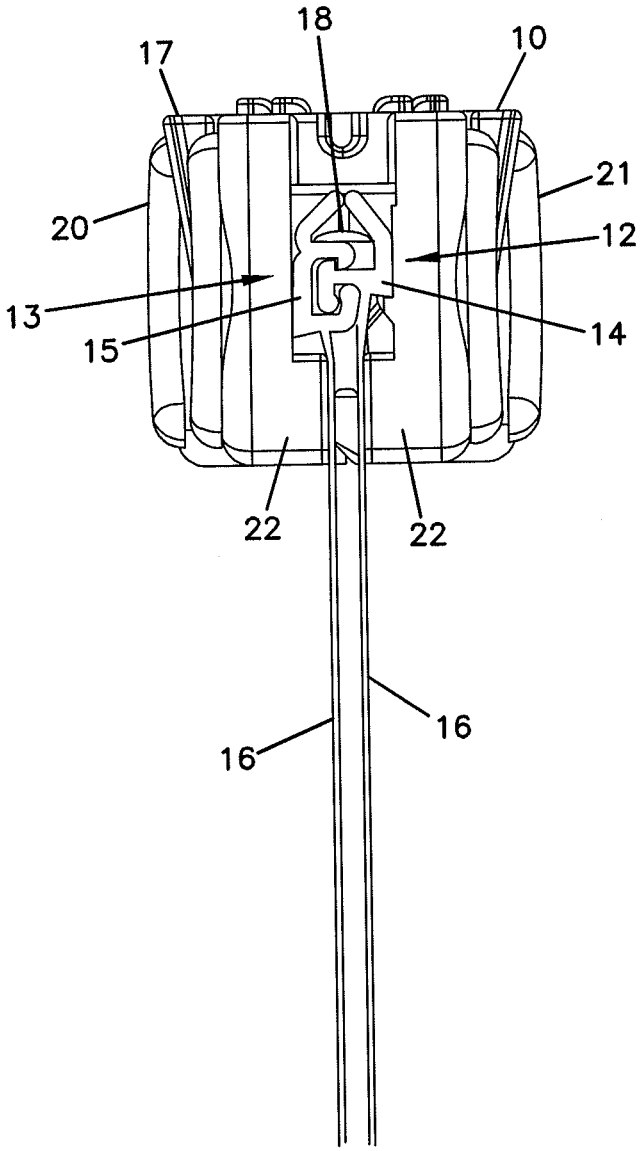
FIG. 3 is an end view of an example male and female track and slider, useable in the bag of FIG. 1.
Figure 9:
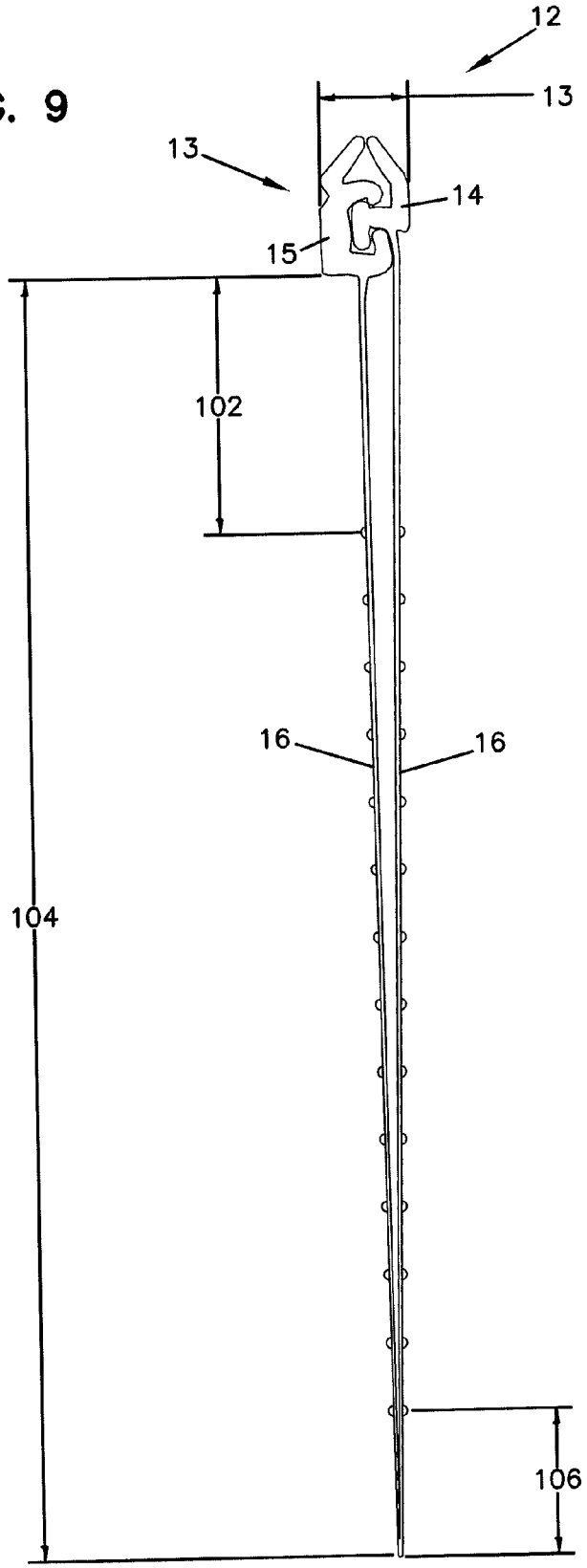
FIG. 9 an end view of an example male and female track, useable in the bag of FIGS. 1 and 4.
Figure 10:
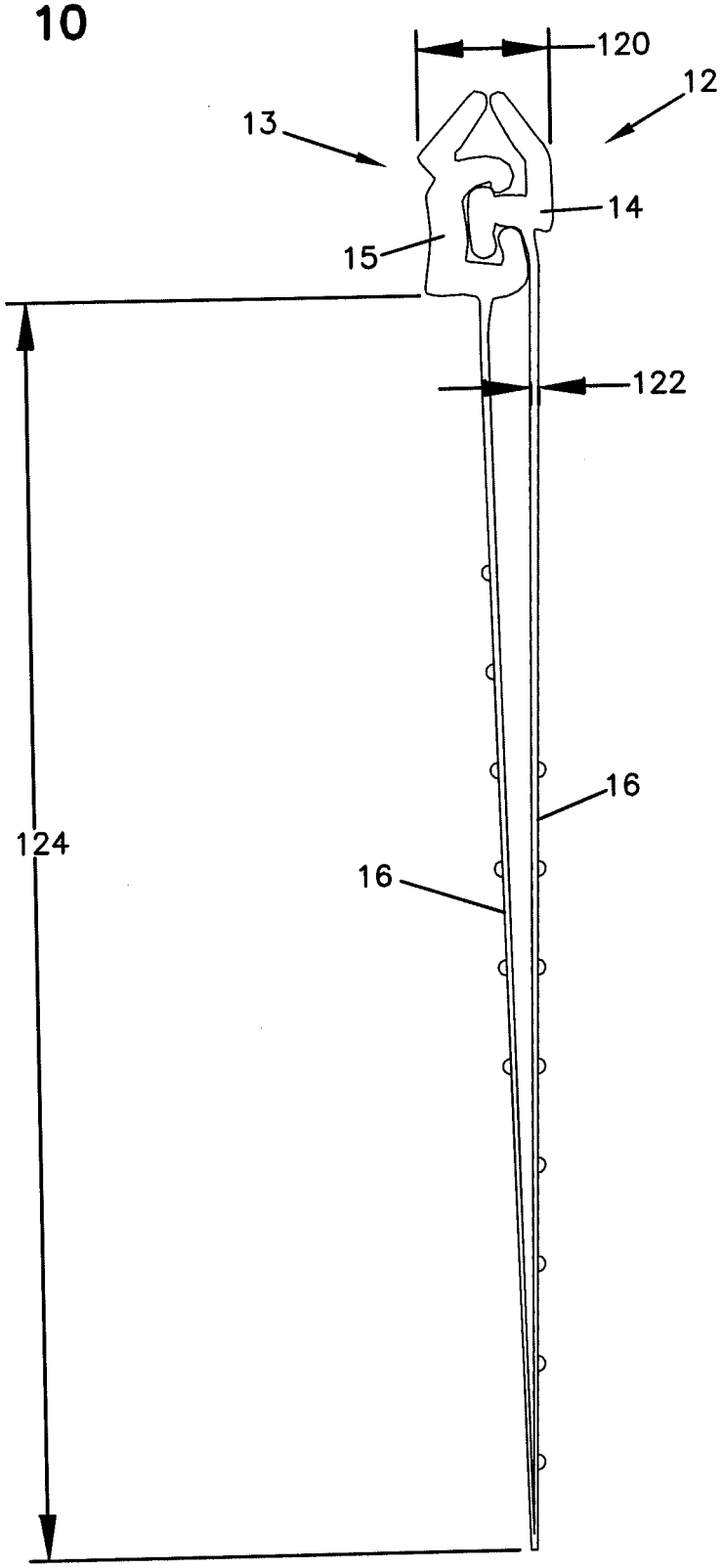
FIG. 10 is an end view of another example male and female track, useable in the bag of FIGS. 1 and 4.

FIG. 3 shows an end view of one useable slider 10 operably mounted on the zipper closure 11. FIGS. 5-8 show another slider 10, useable with the bag B. FIGS. 9 and 10 show two further example zipper closures 11 useable with the bag B. Like parts include the same reference numerals.

As shown in FIG. 3, tracks 12 and 13 have interlocking male and female profiles 14 and 15 extending the length thereof in the form of rib and groove elements on the respective tracks. The tracks 12 and 13 may be extruded separately with a fin and attached to the respective sides of the bag mouth 40, or may be extruded integrally with the sides of the bag mouth 40. If the tracks 12 and 13 are extruded separately, they can be attached by a respective first and second fin 16, incorporated within the tracks, that is heat sealed to the bag mouth 40.

The male and female profiles 14 and 15 have complementary cross-sectional shapes and are closed by pressing a bottom of the elements together first and then rolling the elements to a closed position toward the top thereof. The cross-sectional shapes of the interlocking male and female profiles 14 and 15 can be those as described in U.S. Pat. No. 5,007,143, which is incorporated herein by reference. The male and female profiles may also be "press to close" zipper profiles that do not use a slider for opening and closing. Many embodiments are possible.

The slider 10 straddles the zipper closure 11 at the top of the bag B and is adapted for opening or closing the interlocking tracks 12 and 13 of the zipper closure 11. The slider 10 may be molded from any suitable plastic such as, for example, nylon, polypropylene, polyethylene, polystyrene, Delrin, or ABS. The slider 10 can be as described in U.S. Pat. No. 6,376,035, which is incorporated herein by reference. Other embodiments are possible.

In the example embodiments, the slider 10 comprises an inverted U-shaped member including a transverse support member or body 17 from which the separator finger 18 extends downward. The body 17 includes opposite side walls 20, 21, which each has an inwardly extending shoulder structure 22. The body 17 is adapted to move along the top edges of the tracks 12 and 13 with sidewalls 20, 21 straddling these elements, and the finger 18 positioned between the tracks 12 and 13. Shoulder structure 22 engages a bottom of the zipper closure 11 to prevent the first slider 10 from being lifted off the edges of the tracks 12 and 13, while the slider 10 straddles the zipper closure 11.

The slider 10 has an opening end 50 and a closing end 52. See FIG. 1. The opening end 50 of the slider 10 separates or unlocks the male and female profiles 14 and 15 by the finger 18 engaging the tracks 12 and 13. The closing end 52 of the slider 10 presses the male and female profiles 14 and 15 into an interlocking relationship as the first slider 10 is moved in a fastener closing direction.

In this example embodiment, the opposite ends of the zipper closure 11 are provided with end termination clips 23 (FIGS. 1 and 4). Each end clip 23 can include a strap member which wraps over the top of the zipper closure 11.

As mentioned above, if contents 54 of the bag B are potentially harmful or hazardous, it is desirable to have a child resistant closure to help prevent children from being able to access the contents of the bag B. In accordance with principles of this disclosure, the bag B has a child resistant feature.

The bag B includes a hood arrangement 60. The hood arrangement 60 includes at least a non-removable hood section 62 in covering relation to a first portion 64 of the zipper closure 11. As can be seen in FIG. 1, in options that use slider 10, the non-removable hood section 62 is sized to accommodate within and cover the slider 10. In this manner, the slider 10 can be parked within the non-removable hood section 62 and be hidden from vision, especially from the perspective of a child. In preferred implementations, the non-removable hood section 62 is opaque or non-transparent. This further helps in hiding the slider 10 from visual detection by a child.

In options that do not use slider 10, the first portion 64 of the zipper closure 11 will be an opening initiation point covered by the non-removable hood section 62.

In general, the non-removable hood section 62 will cover the first portion 64 of the zipper closure 11, which will include either slider 10 or an opening initiation point, and will require a degree of dexterity to open the zipper closure 11.

Figure 2:
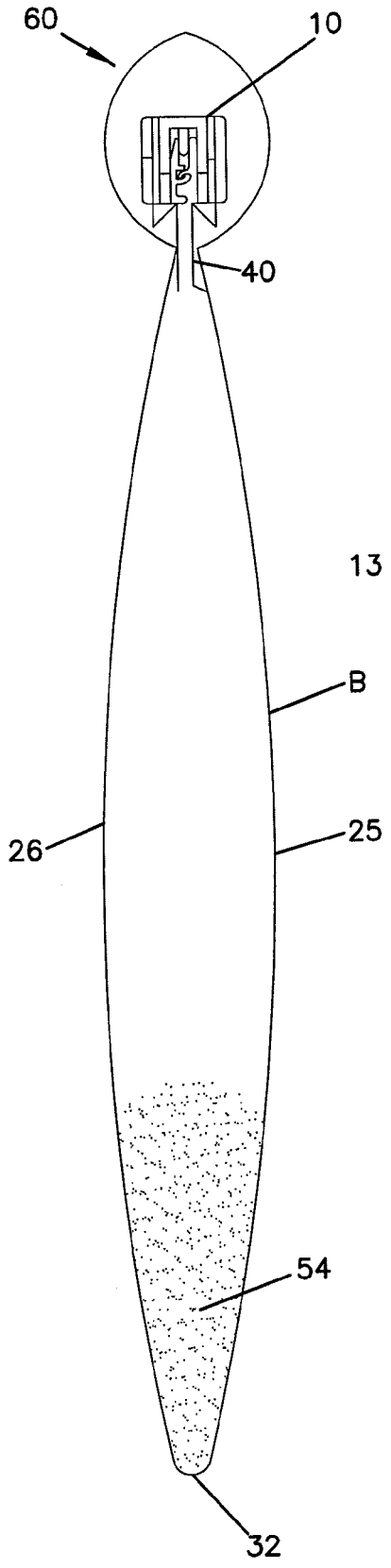
FIG. 2 is schematic cross-sectional view of the bag of FIG. 1, but before the removable hood section is removed.

In the example embodiments shown, the hood arrangement 60 includes an open position and a closed position. In the closed position, the hood arrangement 60 can cover (in one non-limiting example) an entire extension of the zipper closure 11. For example, the embodiment of FIGS. 2 and 4 shows the hood arrangement 60 before any part of it has been removed from the bag B. In the closed position, there will be no portion of the zipper closure 11 or slider that is physically exposed; that is, the entire zipper closure 11 and slider 10 are covered by the hood arrangement 60.

In other non-limiting examples, the hood arrangement 60 can be less than an entire extension of the zipper closure 11, i.e., a partial hood extending only partially along the zipper closure 11. The hood arrangement 60 can be any size and may be open on one or more sides, in some non-limiting examples. In some examples, the hood arrangement 60 can be held closed on the body panels 25, 26 with tack, adhesive, or hard seal. Many variations are possible.

In the open position, the hood arrangement 60 includes only the non-removable hood section 62 covering no more than the first portion 64 of the zipper closure 11. In examples where a slider is used, the first portion 64 of the zipper closure 11 will be a portion of the zipper closure 11 where the slider 11 is parked, and the zipper closure 11 is in a closed and interlocked position. Many embodiments are possible. In the example shown in FIG. 1, the first portion 64 extends less than half of the zipper closure 11, and typically, less than a third of the length of the zipper closure 11.

In example implementations, the hood arrangement 60 may be secured to the first and second panels 25, 26. The hood arrangement 60 may be a continuous piece of film with at least one of the body panels 25, 26 in some examples. In some examples, the hood arrangement 60 may be an independent piece of film that is then secured to the body panels 25, 26. In some examples, the hood arrangement 60 may be film that is secured to the fins 16 of the male and female profiles 14, 15. Many embodiments are possible.

In the closed position, the hood arrangement 60 includes a removable hood section 66 and the non-removable hood section 62. The removable hood section 66 is removable from a remaining portion of the bag B. If the hood arrangement 60 is secured to the first and second panels 25, 26, then the removable hood section 66 is removable from the first and second panels 25, 26 to expose a portion 70 of the zipper closure 11 when removed.

To permit easy removal of the removable hood section 66, a variety of techniques can be used. In one example, the removable hood section 66 is removable from the first and second body panels 25, 26 along a score line 68. In FIG. 1, the score line 68 is shown already broken, with the removable hood section 66 removed from the remaining portion of the bag B. The score line 68 can be in the form of a laser score on film at an intersection of the removable hood section 66 and a remaining portion of the bag B (which can be panels 25, 26; or flanges 16, for example). The removable hood section 66 could also be removed by cutting; having a die line, which may be made with laser scores; or, by having perforations. The score line 68 can be straight or contour, and it can run a length of the zipper closure 11, or it may extend only a partial length. Many embodiments are possible.

In should be understood that the bag B can be made including only the non-removable hood section 62; or, the bag B can be made with both the non-removable hood section 62 and the removable hood section 66.

Figure 11:
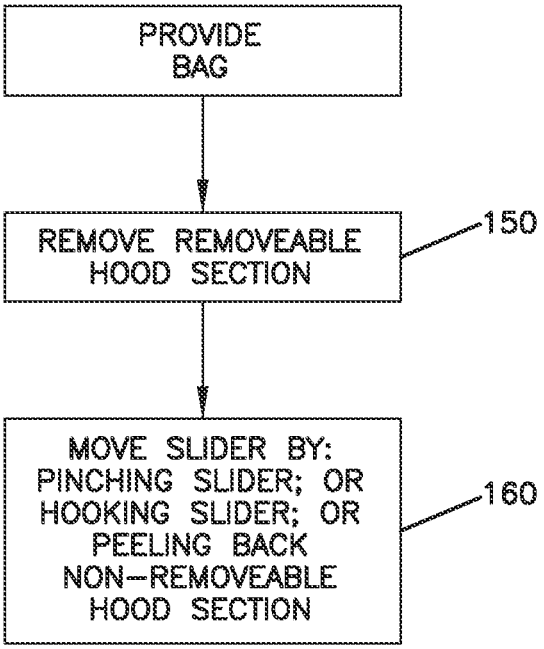
FIG. 11 is a flowchart illustrating an example method, in accordance with principles of this disclosure.

In use, in FIG. 11, if the bag has the removable hood section 66, the user will remove the removable hood section 66 from a remaining portion of the bag B by tearing the removable hood section 66 along the score line 68, in some examples. Of course, as mentioned above, removal of hood section 66 could also be by cutting; or by tearing along die lines; or by tearing along perforations, for example. This will expose portion 70 of the zipper closure 11. See step 150, FIG. 11.

The opening initiation point can then be located within the non-removable hood section 62. If this includes slider 10, the slider 10 is located and moved along the male and female tracks 12, 13 in the direction of the "open arrow" (FIG. 1) to open the mouth 40 by unlocking the male and female profiles 14, 15. To close the mouth 40, the slider 10 is moved along the zipper closure 11 in the opposite direction, in the direction of the "close arrow" (FIG. 1), which will interlock the male and female profile 14, 15. The slider 10 will be moved within the non-removable hood section 62 and parked therewithin. When the non-removable hood section 62 is non-transparent, the slider 10 will be visually hidden, especially from the perspective of a child. In options that do not use slider 10, the open initiation point is located within the non-removable hood section 62, and the zipper closure 11 is opened.

In options that use slider 10, when the slider 10 is within the non-removable hood section 62, and it is desirable to open the mouth 40, the slider 10 can be retrieved from within the non-removable hood section 62 through a variety of techniques. See step 160, FIG. 11. In one technique, the slider 10 is pinched through the non-removable hood section 62 and moved along the male and female tracks 12, 13. In another technique, the slider 10 can be accessed in the non-removable hood section 62 by hooking the slider 10 with a person's finger. In another technique, the slider 10 can be accessed within the non-removable hood section 62 by temporarily peeling back the non-removable hood section 62 to access the slider 10.

The above description represents example principles of this disclosure. Many embodiments can be made applying these principles.

What is claimed is:

1. A child resistant slider zipper closure system comprising:

(a) a zipper closure selectively closable and openable;

(b) a slider operably mounted on the zipper closure to open and close the zipper closure, the slider having a body with an upper wall and first and second opposite side walls extending from the upper wall; and (c) a non-removable hood covering the slider including the upper wall and first and second side walls of the slider such that no portion of the slider is physically exposed when the zipper closure is closed and covering the zipper closure at an opening initiation point of the zipper closure; the non-removable hood being a thermoplastic film extending only partially along the zipper closure from the opening initiation point and being sealed above the opening initiation point; the slider being movable from under the non-removable hood to slide along the zipper closure.

2. The slider zipper closure system of claim 1, further comprising a removable hood portion.

3. The slider zipper closure system of claim 1, wherein the non-removable hood is non-transparent.

4. A flexible package comprising the child resistant slider zipper closure system of claim 1.

5. A zippered plastic bag having an openable and recloseable mouth, the bag comprising:

(a) first and second panels each having a top forming the mouth, a bottom, and first and second opposing sides;

(b) a zipper closure in proximity to the top of the first and second panels for interlocking to close the mouth and for unlocking to open the mouth;

(c) a slider oriented on the zipper closure to open and close the mouth by moving along the zipper closure, the slider having a body with an upper wall and first and second opposite side walls extending from the upper wall; and, (d) a hood arrangement including at least a non-removable hood section in covering relation to the zipper closure at an opening initiation point of the zipper closure;

the non-removable hood section being a thermoplastic film extending only partially along the zipper closure from the opening initiation point and being sealed above the opening initiation point; the slider including the upper wall and first and second side walls being covered by the non-removable hood section such that no portion of the slider is physically exposed when the zipper closure is closed, and the slider being movable from under the non-removable hood section to slide along the zipper closure.

6. A bag according to claim 5 wherein:

(a) the hood arrangement includes an open position and a closed position;

(i) in the closed position, the hood arrangement covers an entire extension of the zipper closure; and (ii) in the open position, the hood arrangement includes only the non-removable hood section covering the opening initiation point and less than the entire extension of the zipper closure.

7. A bag according to claim 6 wherein:

(a) the hood arrangement is secured to the first and second panels; and (b) in the closed position, the hood arrangement includes a removable hood section and the non-removable hood section; the removable hood section being removable from the first and second panels to expose the zipper closure when removed.

8. A bag according to claim 7 wherein:

(a) the first and second panels are scored to permit removal of the removable hood section.

9. A bag according to claim 5 wherein:

(a) the non-removable hood section is sized to accommodate the slider.

10. A bag according to claim 5 wherein:

(a) the non-removable hood section is non-transparent.

11. A method of operating a zippered plastic bag having an openable and recloseable mouth; the method comprising:

(a) providing a zippered plastic bag having first and second panels each having a top forming the mouth, a bottom, and first and second opposing sides; a zipper closure in proximity to the top of the first and second panels for interlocking to close the mouth and for unlocking to open the mouth; a slider located on the zipper closure, the slider having a body with an upper wall and first and second opposite side walls extending from the upper wall; and a hood arrangement including at least a non-removable hood section in covering relation to the zipper closure at an opening initiation point of the zipper closure; the non-removable hood section being a thermoplastic film extending only partially along the zipper closure from the opening initiation point and being sealed above the opening initiation point; the slider including the upper wall and first and second side walls being covered by the non-removable hood section such that no portion of the slider is physically exposed when the zipper closure is closed, and the slider being movable from under the non-removable hood section to slide along the zipper closure; and (b) opening the mouth by accessing the slider in the non-removable hood section and moving the slider along the zipper closure to unlock the zipper closure.

12. A method according to claim 11 wherein:

(a) the hood arrangement includes a removable hood section and the non-removable hood section; and (b) the method further includes, before the step of opening the mouth, removing the removable hood section to expose a portion of the zipper closure.

13. A method according to claim 12 wherein:

(a) the step of removing the removable hood section includes tearing the removable hood section from the first and second panels along a score line.

14. A method according to claim 11 wherein:

(a) the step of moving the slider includes pinching the slider through the non-removable hood section.

15. A method according to claim 11 wherein:

(a) the step of moving the slider includes hooking the slider with a finger.

16. A method according to claim 11 wherein (a) the step of moving the slider includes temporarily peeling back the non-removable hood section.

* * * * *